US005377744A

United States Patent [19]

Maddock

[11] Patent Number: 5,377,744

[45] Date of Patent: Jan. 3, 1995

[54] METHOD AND DEVICE FOR CONTINUOUS CASTING AND EXTRUSION

[75] Inventor: Brian Maddock, West Ridge, England

[73] Assignee: Holton Machinery Limited, Dorset, England

[21] Appl. No.: 952,729

[22] PCT Filed: Jun. 27, 1991

[86] PCT No.: PCT/GB91/01041

§ 371 Date: Nov. 19, 1992

§ 102(e) Date: Nov. 19, 1992

[87] PCT Pub. No.: WO92/00156

PCT Pub. Date: Jan. 9, 1992

[30] Foreign Application Priority Data

Jun. 28, 1990 [GB] United Kingdom ..... 9014437

[51] Int. Cl.[6] ..... B22D 11/06

[52] U.S. Cl. ..... 164/476; 164/154.4; 164/154.5; 164/454; 164/452; 164/479; 164/430

[58] Field of Search ..... 164/479, 429, 430, 476, 164/449, 451, 452, 453, 454, 413, 154.4, 154.5

[56] References Cited

U.S. PATENT DOCUMENTS

| | | | |
|---|---|---|---|
| 1,841,297 | 1/1932 | Perry | 164/476 |
| 3,281,903 | 11/1966 | Ross | 164/430 |
| 3,331,123 | 7/1967 | Cofer | 164/476 |
| 3,354,937 | 11/1967 | Jackson, Jr. | 164/479 |
| 3,835,917 | 9/1974 | Gyongyos | 164/430 |

FOREIGN PATENT DOCUMENTS

| | | | |
|---|---|---|---|
| 2502995 | 10/1982 | France . | |
| 57-47509 | 3/1982 | Japan | 164/449 |
| 1-5649 | 1/1989 | Japan | 164/430 |
| 2095592 | 10/1982 | United Kingdom . | |
| 8302783 | 3/1983 | WIPO | 164/476 |

OTHER PUBLICATIONS

Patent Abstracts of Japan vol. 4, No. 37 (M-4) (519) 27 Mar. 1980 and JP,A,55 010 335 (Hitachi Seisakusho K.K.) 24 Jan. 1980.

Patent Abstracts of Japan vol. 12, No. 109, (M-682) (2956) 8 Apr. 1988 & JP,A,62 240 146 (Kawasaki Steel Corp.) 20.

Patent Abstracts of Japan vol. 10, No. 234 (M-507) (2290) 14 Aug. 1986 & JP,A,61 067 544 (Ishikawajima Harima Heavy Ind. Co. Ltd) Apr. 7, 1986.

*Primary Examiner*—P. Austin Bradley
*Assistant Examiner*—Erik R. Puknys
*Attorney, Agent, or Firm*—Fay, Sharpe, Beall, Fagan, Minnich & McKee

[57] ABSTRACT

Apparatus consists of an articulated continuous casing machine (1) in which a mould for casting bar (18) moves endlessly from an upstream end to a downstream end of a path on the urging of an engine (15). To enable the cast bar to be fed directly into a continuous extrusion machine (2), the engine (15) engages the mould via a slipping clutch (15A) so that in operation an axial compressive force is applied to the cast bar in the mould.

11 Claims, 2 Drawing Sheets

METHOD AND DEVICE FOR CONTINUOUS CASTING AND EXTRUSION

The present invention concerns the provision of apparatus for and a method of manufacturing extruded metallic products by casting and subsequently extruding a bar of metal alloy. The alloy will commonly be aluminium and for the present purposes the term alloy should be understood to include the pure metal as well as mixtures with other elements and compounds. It should be understood that alloys of other metals such as copper or magnesium may also be processed in accordance with the present invention.

It is frequently desirable to recycle scrap alloys. To achieve this it is commonly necessary to first cast the scrap into an elongate bar ready for subsequent processing. An articulated continuous casting machine suitable for this purpose is disclosed in GB-1305964. This continuous casting machine has two mould sub-assemblies each of which consists of a train of mould elements supported by an endless track and engaged with a drive means to be continuously displaced around the track. Each track has an elongate mould section co-extensive with and opposite the mould section of the other sub-assembly. As the mould elements are moved into this section, the mould element in front is engaged and a corresponding mould element of the other, overlying, subassembly is engaged. Thus, an elongate, closed mould is assembled and moves continuously from an upstream end of the mould section to the downstream end. At the downstream end each mould element separates from the following mould element and is returned to the upstream end. In use molten alloy is continuously injected into the upstream end of the mould, the speed of which is controlled to ensure the solidification of the alloy by the time it reaches the downstream end. Thus a bar of cast alloy can be continuously separated from the mould and either coiled or cut into lengths for subsequent storage and transport before further processing.

While it is sometimes desirable to coil and store the bar for later processing, it is also at times desirable to simultaneously cast and further process the bar by extrusion.

Continuous extrusion is commonly carried out in a continuous extrusion machine such as that disclosed in Lamitref's patent application GB-2095592. Such continuous extrusion machines have a wheel, rotatably mounted in a support structure. An endless groove is formed in the periphery of the wheel and an abutment, mounted adjacent an extrusion die intrudes into the groove. In use, alloy bar is entrained in the groove and drawn around until it engages the abutment. Subsequently friction heats the bar in the groove until the alloy is sufficiently malleable to extrude through the die. In Lamitref's patent application the bar is formed by casting in a wheel and belt caster and fed directly to the continuous extrusion machine.

The apparatus proposed by Lamitref is not useful when it is desired to produce bar stock for storage preparatory to subsequent extrusion processing and consequently lacks versatility. Conversely, it has proven difficult to feed continuously cast bar from the articulated type continuous casting machine to a continuous extrusion machine because of the problems encountered in coordinating the speeds of the casting machine and extrusion machine. This is a difficult problem because the cast bar formed in the casting machine tends to be cracked and susceptible to breakage when subject to stress. It would however by very desirable to enable direct continuous extrusion from bar cast continuously in an articulated casting machine to enhance plant versatility.

Accordingly the present invention seeks to provide apparatus for continuously casting and extruding alloy comprising a continuous casting machine having a mould movable along an endless path, and a continuous extrusion machine arranged downstream of the casting machine characterised in that the mould of the continuous casting machine is of articulated type and the mould is driven by means including a slipping clutch whereby a compressive axial force can be applied to a cast bar fed directly from the casting machine to the extrusion machine.

Further according to the present Invention there is provided a method of continuously casting and extruding alloy comprising the steps of: continuously feeding molten alloy into the upstream end of a moving mould in an articulated, continuous casting machine to cast a bar, feeding the cast bar directly from the continuous casting machine to a continuous extrusion machine and controlling the speeds of the machines so that a compressive axial force is applied to the cast bar to prevent the bar from cracking.

To achieve the method defined above the drive means of the casting machine of the apparatus according to the invention is powered at a level which would move the mould at a speed exceeding the rate at which the cast bar is ingested by the extrusion machine. Consequently the cast bar is pushed in an upstream direction and slips, relatively upstream in the mould, thereby compensating for the shrinkage of the cast bar relative to the mould and preventing the cast bar from cracking.

Preferably the slipping clutch is of friction type. However, electromagnetic or hydraulic coupling devices may also be useful for the present purposes.

It is preferable to control the speed of the continuous extrusion machine (that is to sat the wheel speed) in accordance with the dimensions of the cast bar sensed by a sensor device, so that the dimensions of the cast bar are maintained substantially constant. This is found to be more convenient than varying the rate of introduction of molten alloy to the mould.

In known continuous casting machines of the articulated type, two trains of moulds are required to assemble the mould. This leads to a complex machine into which it is difficult to introduce molten alloy, especially where it is desired to cast bar of small section (that is having a section of less than 25×25 mm).

Consequently an aspect of the present invention provides a casting machine of articulated type having not more than a single train of mould elements supported to be moved around an endless path to form an endlessly movable elongate mould. In this case the mould comprises an elongate channel which is open at the top at least the upstream end at least. Thus molten alloy can readily be poured into the mould. By providing for an open topped channel mould, it is possible to easily introduce molten alloy into a mould having dimensions to cast a bar of less than 25×25 mm square section or similar sectional area. Furthermore it is advantageous in that the cast bar is readily accessible through the open top for the purpose of sensing the thickness and hence the cross section of the bar as far upstream as possible. Thus, the single train continuous casting machine is particularly well adapted to the apparatus and method of the invention.

In the conventional articulated continuous casting machine the elements of the mould are displaced at one speed while the elements travelling along the path from the downstream end to the upstream end are driven at a different speed. This demands a complex drive mechanism. In a preferred form of the articulated casting machine according to the present invention, each mould element engages the leading and following mould elements. Thus when one mould element is displaced, all of the elements in the train are displaced at the same speed making speed control much simpler. The conventional continuous casting machine requires the mould elements to be supported by an endless track. However, the casting machine according to a preferred construction embodying the present invention has each mould element linked to the mould element in front of it by means of an articulated joint. Thus the mould elements form an endless articulated belt which can conveniently be supported by two horizontally spaced pulleys and the mould supported by several rollers. The belt may thus be advantageously driven via one of the pulleys engaged with a motor via the slipping clutch.

An example of apparatus and a method embodying the present invention will now be described, with reference to the accompanying drawings in which.

Figure 1:
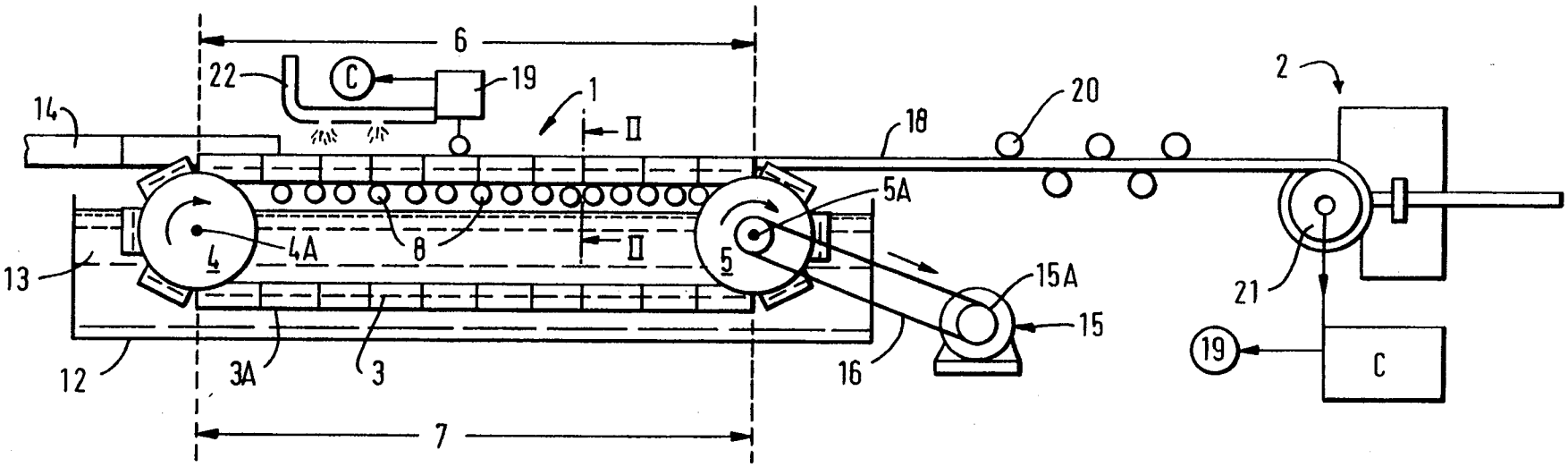
FIG. 1 is a diagrammatic side view of the apparatus.
Figure 2:
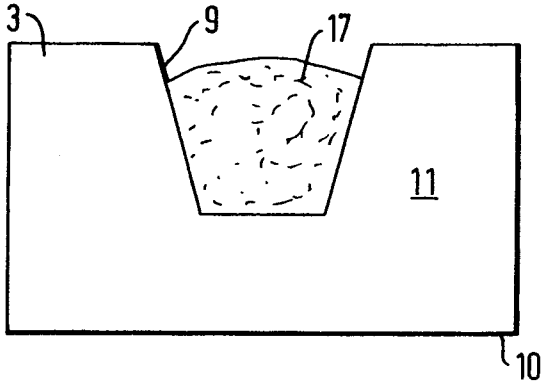
FIG. 2 is a view on the line II—II of a mould element of the apparatus.
Figure 3A:
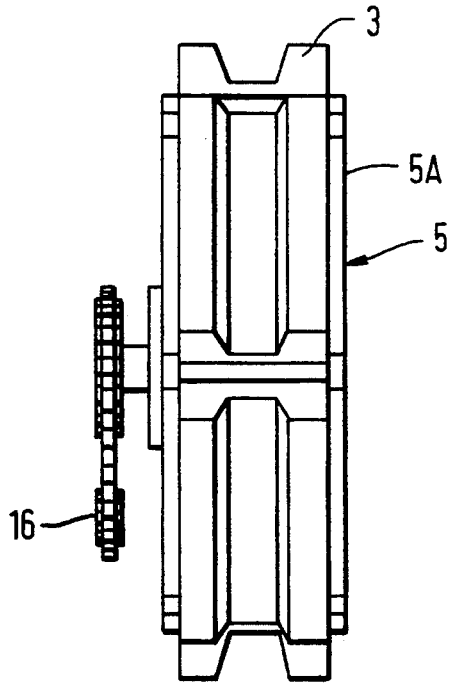
Figure 3B:
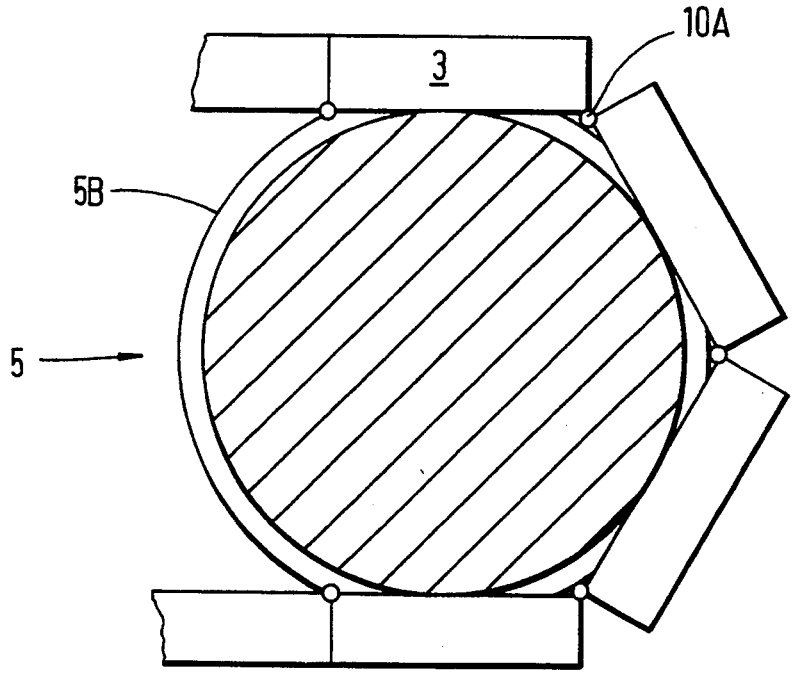

FIGS. 3*a* and 3*b* are enlarged views of the mould elements supported on pulleys, Referring to the figures, the apparatus comprises an articulated casting machine 1, a continuous extrusion machine 2 and a control unit 'C'.

The continuous casting machine 1 has an endless articulated belt 3A formed from many mould elements 3. The belt 3A is entrained around two horizontally spaced pulleys 4, 5 mounted for rotation about horizontally disposed axis 4A, 5A. Thus the belt 3A can be displaced around an endless path. The path includes an uppermost mould section defined by the part of the belt 3A extending between the upper peripheries of the pulleys 4, 5; and a cooling section consisting of the part of the belt 3A extending between the lower peripheries of the pulleys 4 and 5.

Each mould element 3 comprises an elongate block with a channel 9 extending longitudinally in it and opening into the outermost surface of the mould element 3. The innermost edges 10 of the ends of each mould element are connected by pivots 10A to the adjacent edge 10 of the adjacent mould element to articulately join the elements 3 into the articulated belt 3A. The end faces 11 of each mould element 3 are adapted to co-operate with the adjacent end face 11 of each adjacent mould element when the elements are traversing the mould section 6 of the path, to form a leak proof junction.

In operation, the pulleys 4, 5 rotate in a clockwise direction so that the portion of the belt extending along the mould section 6 moves in a downstream direction from the pulley 4 to the pulley 5. As each mould element 3 moves into the upstream end of the mould section it cooperates with the preceding mould element to form a mould. The mould is supported by freely rotatable rollers 8 to prevent sagging.

The cooling section 7 of the path passes through a bath 12 of coolant water 13.

An alloy feeding station is provided by a chute 14 which is arranged to feed molten alloy into the upstream end of the open topped mould during use.

A motor 15 engages the pulley 5 by means of a drive chain 16 and a slipping clutch 15A so that operation of the engine 15 rotates the pulley 5 and propels the belt 3A around the endless path. It should be appreciated that the drive arrangement shown, may be varied by driving the pulley via a gear train or drive shaft. The slipping clutch may be a simple friction clutch, an electromagnetic clutch or an hydraulic clutch.

In some embodiments of the apparatus (not shown) a single engine can be arranged to drive both the casting machine and the extrusion machine, via suitably geared drive trains.

In the preferred embodiment the pulleys 4, 5 are circular and have radially extending flanges 5B. The pins of the articulated joints project laterally from the mould elements to ride on the rims of the flanges. To improve driving engagement between the pulley 5 and the belt 3A the flanges may be notched.

In an alternative embodiment of the apparatus the pulleys 4, 5 may be polygonally shaped so that flat faces of the pulleys 4, 5 engage the undersides of the mould elements.

In use the belt is displaced by operation of the engine 15 so that the mould moves endlessly downstream. Once the mould is in motion molten alloy 17 is introduced into the mould by the chute 14 at a constant rate. As the alloy is carried towards the downstream end of the mould it cools into a cast bar 18 which is then separated from the mould at the downstream end. It will be appreciated that by cooling the mould elements 3 in the birth 12 the rate of cooling the molten alloy 17 is increased thereby enabling the mould to be made of short length. Cooling is further enhanced by spraying coolant from sprays 22 onto the mould elements of the mould.

As the cast bar 18 is separated from the mould it is guided by rolls 20 into the continuous extrusion machine 2. The continuous extrusion machine has a wheel 21 with an endless groove (not shown) formed in it. The wheel is rotationally driven by a motor (not shown) so that the alloy bar 18, which is entrained in the groove is drawn into the extrusion machine 2, heated and pressurised by frictional engagement with the groove and forced through an extrusion die in known fashion.

During the continuous casting and extrusion process the speed of the casting machine motor 15 and the speed of the wheel 21 are sensed and controlled so that the slipping clutch 15A is constantly slipping because the casting machine motor 15 is trying to propel the mould and cast bar 18 at a speed exceeding the feed rate of the continuous extrusion machine 2. Thus a compressive axial force as applied to the cast bar 18. This has the effect of preventing cracking and compensating for shrinkage of the cast bar, hence alleviating the risk of the cast bar breaking.

The speed of the casting machine motor can thus be set and maintained constant without complex controls.

To control the thickness of the cast bar 18, the speed of the wheel 21 is controlled by an electronic control unit C in accordance with the thickness of the bar detected by a sensor 19. If the sensor 19 detects an increase in the bar thickness beyond a predetermined range value the speed of the wheel 21 is increased. This allows the cast bar to move more quickly thereby increasing the speed of the mould and hence reducing the thickness of the bar towards an acceptable range value. Conversely, if the thickness of the bar detected by the sensor 19 decreases below a predetermined lower range value, the speed of the wheel 21 is reduced so that the cast bar moves at a slower speed thereby reducing the speed of the mould and returning the bar thickness to an acceptable range value. Thus the bar thickness can be maintained constant without the disadvantageous problem of varying the feed rate of molten alloy to the mould.

It will be appreciated from this that the simple feature of including a slipping clutch in the drive to the casting machine and driving the casting machine motor 15 so that an axial force is always applied to the cast bar as it separates from the mould provides a simple and reliable way of preventing the bar breaking.

It will readily be recognised that the articulated continuous casting machine can also be operated to cast bar for subsequent coiling and storage. In this case it is still advantageous to apply the compressive axial force to prevent the bar breaking. Other advantages of the casting machine, such as the relatively simple construction will also be apparent.

We claim:

1. Apparatus for continuously casting and extruding metal comprising a continuous casting machine (1) having a mould movable along an endless path, and a continuous extrusion machine (2) arranged downstream of the casting machine (1) the continuous casting machine (1) having an articulated mould driven by a drive around the endless path via a slipping clutch (15A) whereby the drive can be arranged to apply a compressive force to a cast bar (18) fed directly from the casting machine to the continuous extrusion machine (2), the compressive force being governed by the slipping clutch (15A), a bar thickness sensor (19), a control unit (C) being means for controlling the rate at which the continuous extrusion machine ingests the cast bar in response to the bar thickness measured by the sensor, so that the speed of the continuous casting machine (1) is governed by the speed of the continuous extrusion machine whereby the bar thickness can be maintained constant.

2. Apparatus according to claim 1 wherein the casting machine (1) comprises not more than one endless path.

3. Apparatus according to claim 2 wherein the mould is formed from a plurality of mould elements (3A) and each mould element (3A) engages the mould element in front of it at all times.

4. Apparatus according to claim 3 wherein the mould elements (3A) engage by means of a joint articulated by a pivot (10A) to form an endless belt.

5. Apparatus according to claim 4 wherein the endless belt is supported by two horizontally spaced pulleys (4, 5) mounted for rotation about horizontal axes.

6. Apparatus according to claim 5 wherein a casting machine motor (15) engages one of the pulleys (5) to provide the drive means to propel the belt around the endless path.

7. Apparatus according to claim 5 wherein the lower part of the belt is immersed in a coolant bath (12).

8. Apparatus according to claim 5 wherein the upper part of the belt spanning between the pulleys (4, 5) forms the mould, and spray means (22) is disposed to cool the mould.

9. Apparatus according to claim 1 wherein the mould is open topped to permit easy introduction of the alloy.

10. Apparatus according to claim 9 to wherein the mould comprises a casting channel to cast a bar with a cross section of not more than 625 $mm^2$.

11. A method for continuously casting and extruding metal comprising the steps of:

continuously feeding molten metal into the upstream end of a moving articulated mould in a continuous casting machine to cast a bar, feeding the cast bar directly from the continuous casting machine to a continuous extrusion machine, operating at least one engine to drive the continuous casting machine and the continuous extrusion machine, applying a compressive axial force to the cast bar characterised in that the drive to the continuous casting machine includes a slipping clutch to govern the compressive force, and controlling the rate at which the continuous extrusion machine ingests the cast bar by a control unit responsive to the thickness of the bar being cast, whereby the speed of the casting machine is controlled by the speed of the continuous extrusion machine so that the bar thickness and feed rate of molten metal can be maintained constant.

* * * * *